US009078311B2

(12) United States Patent
Hast et al.

(10) Patent No.: US 9,078,311 B2
(45) Date of Patent: Jul. 7, 2015

(54) LIGHTING MODULE AND A CORRESPONDING LIGHTING SYSTEM

(71) Applicant: OSRAM GmbH, Munich (DE)

(72) Inventors: Michael Hast, Munich (DE); Lorenzo-Roberto Trevisanello, Abano-Terme (IT); Franco Zanon, Cassola (IT)

(73) Assignee: Osram GmbH, Munich (DE)

( * ) Notice: Subject to any disclaimer, the term of this patent is extended or adjusted under 35 U.S.C. 154(b) by 0 days.

(21) Appl. No.: 14/372,222

(22) PCT Filed: Jan. 15, 2013

(86) PCT No.: PCT/IB2013/050360
§ 371 (c)(1),
(2) Date: Jul. 15, 2014

(87) PCT Pub. No.: WO2013/108175
PCT Pub. Date: Jul. 25, 2013

(65) Prior Publication Data

US 2015/0022115 A1 Jan. 22, 2015

(30) Foreign Application Priority Data

Jan. 16, 2012 (IT) ..... TO2012A0025

(51) Int. Cl.
*H05B 33/08* (2006.01)
*H05B 37/02* (2006.01)
(Continued)

(52) U.S. Cl.
CPC ..... *H05B 33/0803* (2013.01); *H05B 33/0818* (2013.01); *H05B 33/0845* (2013.01); *H05B 37/0245* (2013.01); *H05B 37/0254* (2013.01); *H05B 37/0263* (2013.01); *F21K 9/00* (2013.01); *F21V 23/003* (2013.01); *F21V 23/04* (2013.01); *F21Y 2101/02* (2013.01); *F21Y 2105/00* (2013.01); *H05B 37/02* (2013.01)

(58) Field of Classification Search
None
See application file for complete search history.

(56) References Cited

U.S. PATENT DOCUMENTS 4,882,522 A * 11/1989 Brown ..... 315/119
7,750,576 B2 * 7/2010 Pan et al. ..... 315/185 R
(Continued)

FOREIGN PATENT DOCUMENTS

CN 202035174 U 11/2011
WO 0011915 A1 3/2000
WO 2009081424 A1 7/2009

OTHER PUBLICATIONS

International Search Report of PCT/IB2013/050360 mailed on Apr. 15, 2013.
(Continued)

*Primary Examiner* — Crystal L Hammond

(57) ABSTRACT

Various embodiments relate to a lighting module. The lighting module includes at least one light source, regulating means for regulating the brightness of the light emitted by the at least one light source, and a control unit configured for receiving a brightness control signal, and driving the regulation means as a function of the brightness control signal, wherein the control unit is configured for: verifying whether the brightness control signal contains a digital communication signal, and if the brightness control signal includes a digital communication signal, detecting the data transmitted via the digital communication signal and driving the regulating means as a function of the transmitted data, or if the brightness control signal does not includes a digital communication signal, driving the regulating means as a function of the brightness control signal.

12 Claims, 5 Drawing Sheets

(51) Int. Cl.

| | |
|---|---|
| ***F21K 99/00*** | (2010.01) |
| ***F21V 23/00*** | (2015.01) |
| ***F21V 23/04*** | (2006.01) |
| *F21Y 101/02* | (2006.01) |
| *F21Y 105/00* | (2006.01) |

(56) References Cited

U.S. PATENT DOCUMENTS

| | | | | |
|---|---|---|---|---|
| 2002/0117975 | A1* | 8/2002 | Yang | 315/291 |
| 2004/0095079 | A1* | 5/2004 | Matsumoto | 315/291 |
| 2005/0168173 | A1* | 8/2005 | Kato | 315/291 |
| 2008/0315777 | A1* | 12/2008 | Ruxton | 315/193 |
| 2009/0091265 | A1* | 4/2009 | Song et al. | 315/185 R |
| 2010/0019687 | A1* | 1/2010 | Komiya et al. | 315/291 |
| 2011/0140611 | A1 | 6/2011 | Elek et al. | |

OTHER PUBLICATIONS

Chinese OA based on Application No. 2015031000934370 (5 pages) dated Mar. 13, 2015 (for reference purpose only).

* cited by examiner

LIGHTING MODULE AND A CORRESPONDING LIGHTING SYSTEM

RELATED APPLICATIONS

The present application is a national stage entry according to 35 U.S.C. §371 of PCT application No.: PCT/IB2013/050360 filed on Jan. 15, 2013, which claims priority from Italian application No.: TO2012A000025 filed on Jan. 16, 2012, and is incorporated herein by reference in its entirety.

TECHNICAL FIELD

Various embodiments relate to lighting systems.

The description has been drawn up with particular care for the purpose of improving compatibility between electric converters and lighting modules.

BACKGROUND

Electronic converters for light sources comprising, for example, at least one LED (Light Emitting Diode) or other solid state lighting means normally supply a direct current at their outputs. This current can be constant or variable over time, for example in order to regulate the brightness of the light emitted by the light source (by what is known as the "dimming" function).

FIG. 1 shows a possible lighting system comprising an electronic converter 10 and a lighting module 20, comprising, for example, at least one LED L. The electronic converter 10 normally comprises a control circuit 102 and a power circuit 104 (such as an AC/DC or DC/DC switching power supply) which receives a power signal (from the electrical supply line, for example) at its input and supplies a direct current at its output via a power output 106. This current can be fixed or can vary over time. For example, the control circuit 102 can set the current required by the LED module 20 by using the reference channel $I_{Ref}$ of the power circuit 104.

For example, the LED module 20 can also comprise an identification element which identifies the current required by the lighting module 20 (or control parameters in general). In this case, the control circuit 102 communicates with the identification element and adapts the operation of the electronic converter to the operating conditions required by the LED module.

FIG. 1 also shows two further switches 108 and 110.

The first switch 108 can be used to regulate the brightness of the module 20, in other words the light intensity emitted by the lighting module 20. For example, the switch 108 can be driven by pulse-width modulation (PWM) so as to short-circuit the LED module 20 selectively by diverting the current supplied by the generator 104 through the switch 108. As a general rule, however, the light intensity emitted by the LED module 20 can be regulated by regulating the mean current flowing through the lighting module, for example by setting a lower reference current $I_{Ref}$. The second switch 110 can be used to disable the power supply to the module 20. For example, an electronic converter 10 can disable the power supply when an error condition is detected, or for reasons of reliability, for example when a condition of excess current, excess voltage or excess temperature is detected.

FIG. 2 shows an example of a "simple" lighting module which comprises, for example, a chain of LEDs (or "LED chain"), in other words a plurality of LEDs connected in series. For example, FIG. 2 shows four LEDs, L1, L2, L3 and L4.

In this case also, switches can be provided for various purposes (for protecting and/or dimming the module 20, for example). For example, the switch SW5 connected in series with the LEDs L1-L4 can be used to disable the power supply to the module 20, and each of the switches SW1, SW2, SW3, SW4, connected in parallel, respectively, with one of the LEDs L1, L2, L3, L4, can be used to disable a single LED.

The function of the switch 108 of the converter 10 could therefore also be provided by means of a switch in the module 20 which selectively short-circuits the light sources L of the module 20.

As a general rule, a switch of this kind is sufficient if the module 20 is supplied with a regulated current. However, if the module 20 is supplied with a regulated voltage, a current regulator must be connected in series with the light sources in order to limit the current. In this case, the dimming function could also be provided by means of this current regulator, for example:

a) by selectively activating or disabling the current regulator by means of a drive signal such as a PWM signal, or b) if a regulatable current regulator is used, by setting the reference current of this current regulator.

There are also "intelligent" lighting modules which comprise a control unit, and typically a digital communication interface. These lighting modules are typically capable of controlling control parameters of the lighting module and/or the dimming function.

As a general rule, a lighting system therefore comprises numerous sub-circuits which control the operation of the electronic converter 10 and/or the module 20.

Consequently, there are problems of compatibility between electronic converters and lighting modules, if these are not of the same type. This is because an electronic converter intended for use with a simple lighting module cannot recognize an intelligent lighting module, and vice versa. Consequently, the correct lighting module must be selected for a specific electronic converter, or vice versa, and when an electronic converter is replaced by a converter of a different type all the lighting modules must also be replaced.

However, it is inconvenient to use only one type of lighting module. For example, the simpler lighting modules are unable to offer some control parameters. A possible solution to this problem could be to use a control unit in the simpler modules as well. However, such a control circuit would be rather costly and would therefore make this solution inefficient.

Patent application WO 2009/081424, the content of which is incorporated herein by reference, describes, in this context, an electronic converter capable of providing a dimming function for simple 20*a* and intelligent 20*b* lighting modules.

In particular, as also shown in FIG. 3, the electronic converter 10 is configured for supplying the lighting modules with a regulated voltage, for example 24 V d.c., applied between a power supply line Vcc and a ground GND. In this case, the simple lighting modules 20*a* each comprise a light source L connected in series with a current regulator 120, and the light intensity is set directly by means of a PWM signal. The intelligent lighting modules 20*b* each comprise a light source L and a digital communication interface for receiving a data signal DATA, such as a serial communication receiver SR. In this case, the circuit SR detects the digital communication signal, analyses the signal and retrieves the data DATA. On the basis of the transmitted data, the circuit SR sets the light intensity of the light source L by using a corresponding regulatable current regulator.

In particular, this document teaches that the PWM signal and the data signal DATA can be transmitted on the same line 122 by connecting this line selectively to the ground GND by means of an electronic switch 16, such as a power transistor. In general, this document teaches that the PWM signal can be controlled as a function of a dimming signal DS, and the digital communication signal DATA can be used to transmit any data DF, additionally comprising the data for regulating the brightness of the intelligent lighting modules 20*b*.

However, although this document partially resolves the problem of compatibility between different lighting modules, this solution does not allow an intelligent lighting module to be used with an electronic converter intended exclusively for use with a simple lighting module.

SUMMARY

Various embodiments relate to a lighting module. Various embodiments further relate to a corresponding lighting system.

In various embodiments, the lighting module includes at least one light source, such as an LED, and regulating means for regulating the brightness of the light emitted by the light sources. The lighting module further includes a control unit configured for receiving a brightness control signal and for driving the regulating means as a function of the brightness control signal. In particular, in various embodiments, the control unit verifies whether the brightness control signal contains a digital communication signal. If the brightness control signal includes a digital communication signal, the control unit detects the data transmitted via the digital communication signal and drives the regulating means as a function of these data. In the contrary case, the control unit drives the regulating means via the brightness control signal.

For example, in various embodiments, the lighting module includes a first filter for detecting the digital communication signal in the brightness control signal.

In various embodiments, the lighting module further includes a second filter for detecting, in the brightness control signal, a pulse-width modulated signal which can be used to regulate the brightness of the light sources, when the digital communication signal is absent.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

The reference to "an embodiment" in this description is intended to indicate that a particular configuration, structure or characteristic described in relation to the embodiment is included in at least one embodiment. Therefore, phrases such as "in an embodiment", which may be present in various parts of this description, do not necessarily refer to the same embodiment. Furthermore, specific formations, structures or characteristics may be combined in a suitable way in one or more embodiments.

The references used herein are provided purely for convenience and therefore do not define the scope of protection or the extent of the embodiments.

As mentioned above, the present description provides a range of electronic converters and lighting modules which are compatible with each other. For example, in one embodiment, the range comprises at least two types of electronic converters, such as a "simple" and an "intelligent" converter, and two types of lighting modules, such as a "simple" and an "intelligent" module.

In this case, there are four possible scenarios.

In the first scenario, in the case of a low-performance configuration for example, at least one simple lighting module is connected to a simple electronic converter.

Figure 4:
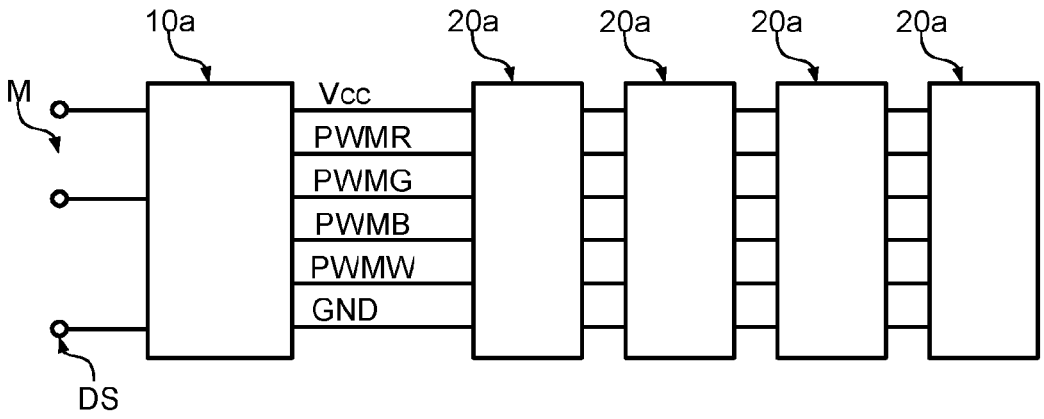
FIGS. 4 and 5 show lighting systems according to the present description.

For example, FIG. 4 shows a circuit diagram in which four simple lighting modules 20*a*, such as LED modules generating red, green, blue and white light respectively, are connected to a simple converter 10*a*.

In the embodiment under consideration, the electronic converter 10*a* receives at its input a power supply signal M and at least one brightness control signal DS. For example, this brightness control signal can be an analog signal, such as an amplitude modulated (AM) signal or a pulse-width modulated (PWM) signal, or a digital signal, such as a signal according to the Digital Addressable Lighting Interface (DALI) standard.

In the embodiment under consideration, the simple electronic converter 10*a* is configured for supplying at its output a power supply signal for the lighting modules 20 and at least one brightness control signal for controlling the brightness of the simple lighting modules 20*a*. As mentioned above, in the case of simple electronic converters 10*a* and lighting modules 20*a* this control signal can be a PWM signal.

As shown in FIG. 4, it is also possible to use a plurality of PWM signals, for example four signals PWMR, PWMG, PWMB, and PWMW. For example, a corresponding PWM signal can be used for each of the LED modules having a certain color, or in a general way for certain assemblies comprising at least one module 20*a*.

In the embodiment under consideration, the power supply signal is a regulated voltage applied between a power supply line Vcc and a ground GND. For example, in this case, the PWM signal can be used to activate or disable the modules 20*a*, for example by controlling the operation of a current regulator within the modules 20*a*.

However, as is also shown in WO 2009/081424, the power supply signal could be applied solely to the line Vcc and the PWM signal could be used to connect the module 20*a* selectively to the ground GND.

In various embodiments, the converter 10*a* is configured for generating the aforementioned PWM signals at a frequency of between 100 Hz and 1 kHz, or preferably between 100 and 200 Hz.

Figure 5:
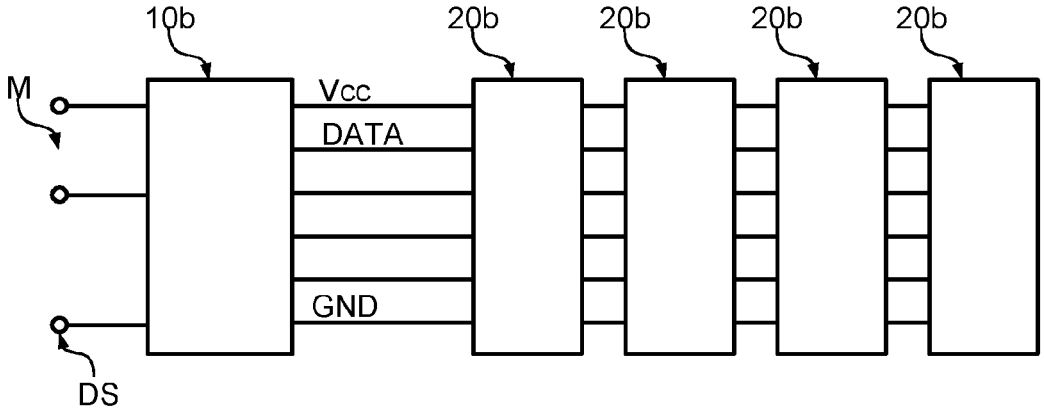

FIG. 5 shows an embodiment of a second scenario, relating to a high-performance configuration for example, in which at least one intelligent lighting module 20*b* is connected to an intelligent electronic converter 10*b*. In this case also, the electronic converter 10*b* receives at its input a power supply signal M and at least one brightness control signal DS, and supplies at its output a power supply signal for the lighting modules 20*b*, such as a regulated voltage between the terminals Vcc and GND, and at least one brightness control signal for controlling the brightness of the intelligent lighting modules 20*b*. In this case, however, use is made of a digital communication signal, in other words a signal in which the data are transmitted in a bit sequence which is modulated (by well-known methods) on the data line DATA.

For example, in one embodiment each module 20*b* can have its own address which can be used to send data to this module only. For example, this allows "point-to-point" communication to be established between the electronic converter 10*b* and a module 20*b*, or additionally between two modules 20*b*. Additionally, it is possible to provide communication of the "broadcast" type, in which a single message is sent to all the lighting modules 20*b*.

As mentioned previously, intelligent converters 10*b* and modules 20*b* typically support a plurality of functions. For example, the converter 10*b* could comprise further inputs, for example for connection to sensors such as an optical sensor, and/or for communication with other devices such as a USB or Ethernet port.

In one embodiment, the converter could configure the communications network between the converter 10*b* and the modules 20*b* by detecting the presence of intelligent lighting modules 20*b* and assigning a corresponding address to each module 20*b*. For example, for the purpose of detecting the presence of intelligent lighting modules 20*b*, each module could signal its presence independently when the module was switched on. Alternatively, each module could comprise a unique pre-set address. In this case, for the purpose of detecting the presence of intelligent lighting modules, each module 20*b* could signal its unique address directly.

In various embodiments, the communication frequency of the digital communication signal is higher than the frequency of the PWM signal described with reference to the first scenario, being for example higher than 1 kHz, or preferably higher than 10 kHz.

In the third scenario, at least one simple lighting module 20*a* is connected to an intelligent electronic converter 10*b*.

In this case, the intelligent electronic converter 10*b* is configured for additionally generating the brightness control signal described with reference to the simple electronic converter 10*a*, in other words at least one PWM signal which is transmitted on the same line as the digital communication signal.

Therefore, if no intelligent module signals its presence, it would be possible for the electronic converter 10*a* to transmit the PWM signal only, without any digital communication signal.

In one embodiment, in order to avoid the detection of this scenario, the intelligent electronic converter 10*b* is configured for transmitting the brightness control signal for the simple lighting modules 20*a* in all circumstances, including the case in which no simple lighting module 20*a* is connected to the intelligent electronic converter 10*b*. Alternatively, the intelligent electronic converter 10*b* could also be configured for transmitting the brightness control signal for the simple lighting modules 20*a* only in the case in which there is no signal indicating the presence of at least one intelligent electronic converter 20*b*.

Preferably, in order to allow the data signal to be detected, the data signal DATA is transmitted when the PWM signal is constant, in other words when the pulse is activated or disabled.

Finally, in the fourth scenario, at least one intelligent lighting module 20*b* is connected to a simple electronic converter 10*a*.

In this case, the intelligent module 20*b* is configured for detecting the brightness control signal for the simple lighting modules 20*a* and for regulating its brightness according to this control signal.

Figure 6:
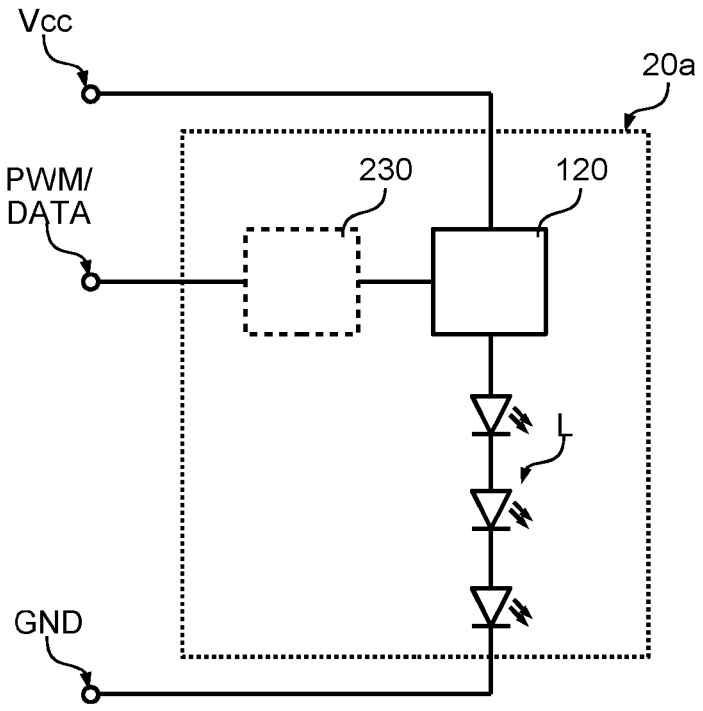
FIGS. 6 and 7 show lighting modules according to the present description.

FIG. 6 shows a circuit diagram of a simple lighting module 20*a* which can be used in the different scenarios described above.

In the embodiment under consideration, the module 20*a* comprises at least one light source, such as an LED L, connected in series with a current regulator 120, such as a resistor (or an impedance element in general) connected in series with an electronic switch, or a linear current regulator. In the embodiment under consideration, the current regulator 120 and the light source L are connected between the power supply line Vcc and the ground GND.

In the embodiment under consideration, the operation of the current regulator 120 is controlled by means of the brightness control signal. As mentioned previously, this signal can comprise a PWM signal and/or a digital communication signal DATA.

Typically, the digital communication signal has a high frequency, and therefore the human eye cannot perceive fluctuations caused by this signal. In one embodiment, however, the brightness control signal may also be filtered by means of a low-pass filter 230 to remove any digital communication signal.

Figure 7:
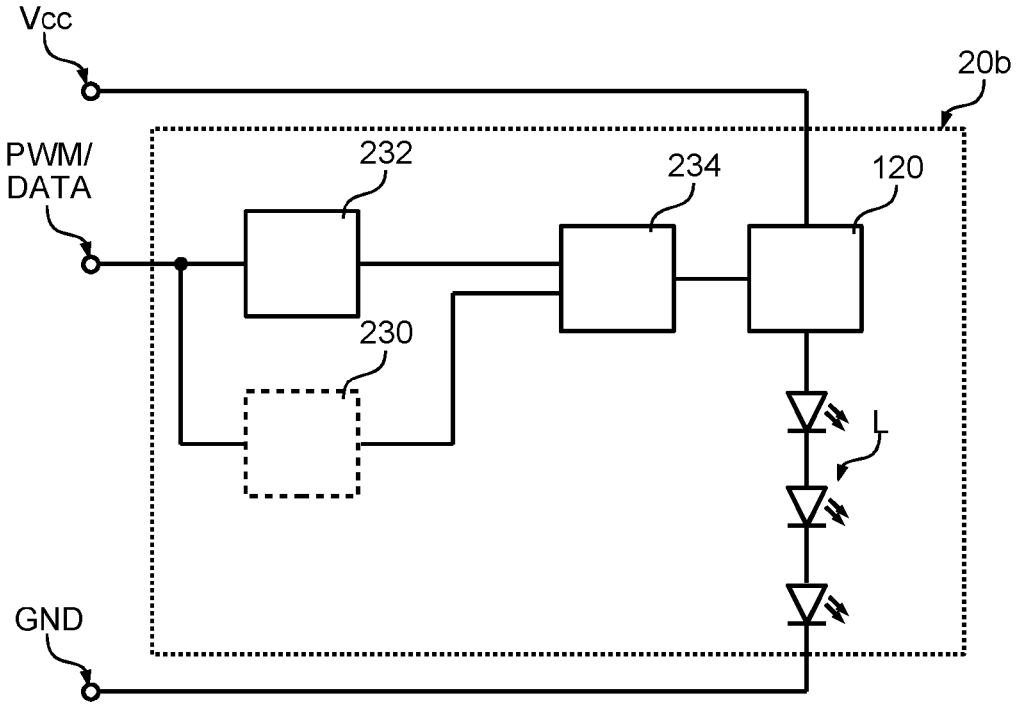

FIG. 7 shows an embodiment of an intelligent lighting module 20*b*.

In this case also, the lighting module can comprise a current regulator 120 and at least one light source L, which are connected between the power supply line Vcc and the ground GND.

In the embodiment under consideration, the module comprises at least one filter 232, such as a high-pass or band-pass filter, configured for detecting the digital communication signal, in other words the brightness control signal for the intelligent lighting modules. In one embodiment, the module 20*b* further comprises a second filter 230, such as a low-pass filter, configured for detecting the PWM signal, in other words the brightness control signal for the simple lighting modules. The filtered signals, in other words the brightness control signal for the simple lighting modules and the brightness control signal for the intelligent lighting modules, are supplied to a control unit 234 such as a microcontroller. The control unit 234 analyzes these signals and drives its current regulator 120 as a function of these control signals.

For example, if brightness control signals for intelligent lighting modules are available, the control unit is configured for rejecting any brightness control signal for simple lighting modules, in other words the PWM signal. In the contrary case, the control unit is configured for using the brightness control signals for the simple lighting modules for driving the current regulator 120, for example by using the PWM signal (or its filtered version if appropriate) directly for driving the current regulator as described with reference to simple lighting modules.

For example, the absence of brightness control signals for intelligent lighting modules can be detected in an explicit way, in other words by periodically checking the content of the received signal, or in an implicit way, for example by checking whether the electronic converter confirms the signaling of the presence of the intelligent lighting module 20*b*. For example, as mentioned previously, the intelligent lighting module 20*b* can signal its presence when the module is switched on, after which the intelligent electronic converter 10*b* can assign an address to the module. Therefore, if the lighting module 20*b* were connected to a simple electronic converter 10*a*, the converter 10*a* would not confirm the signaling of the presence of the intelligent lighting module 20*b*; for example, it would not send an address.

In this case, therefore, the control unit can disable the digital communication interface and use the PWM signal only.

Figure 1:
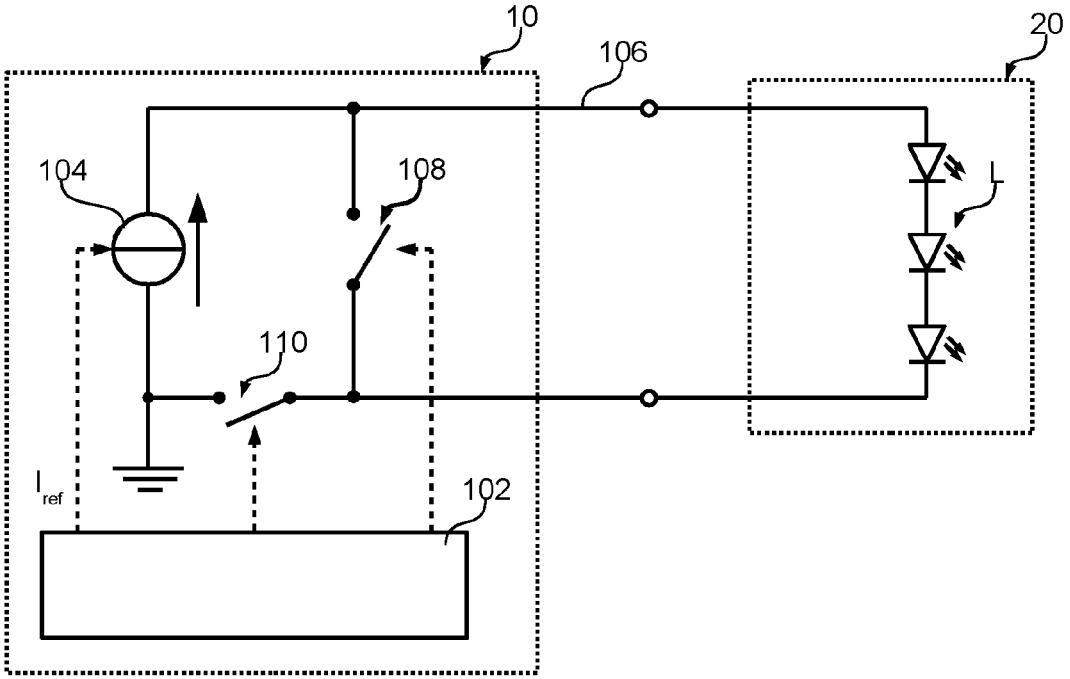
FIGS. 1 to 3 have already been described.
Figure 2:
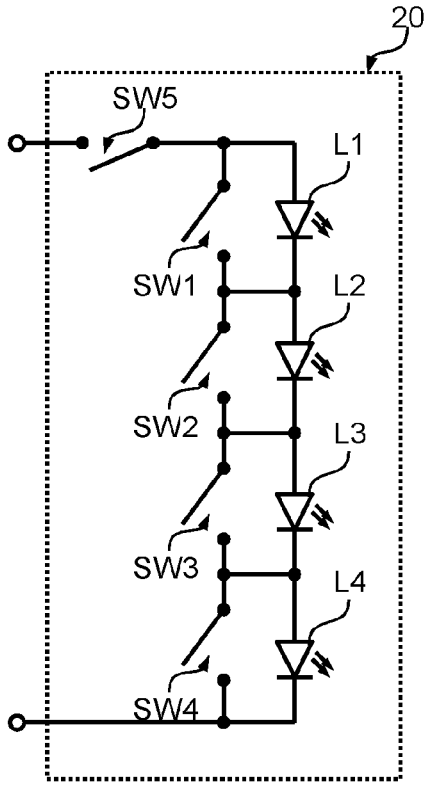
Figure 3:
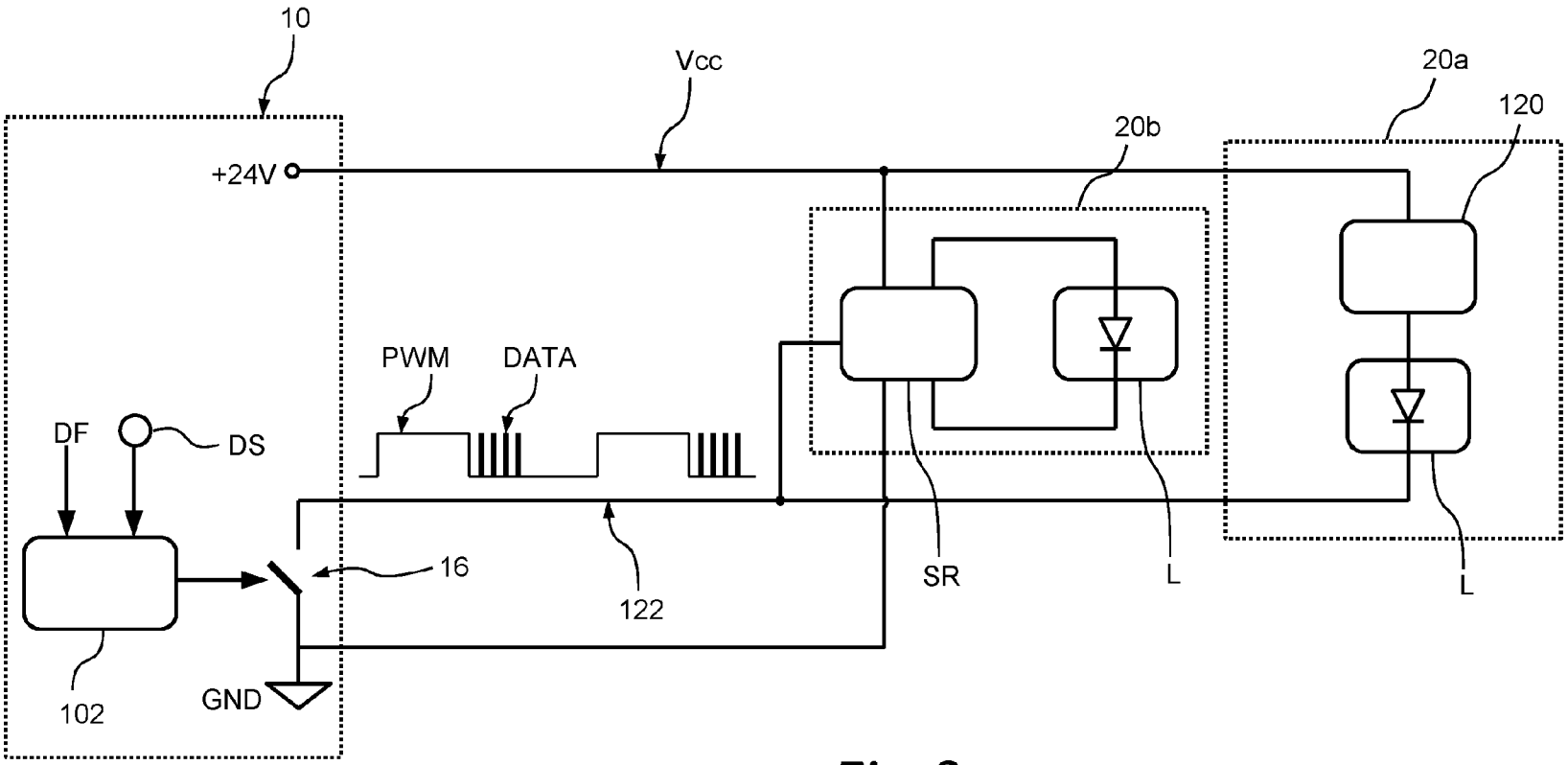

As a general rule, as mentioned previously (particularly with reference to FIG. 2), if the power supply signal is a regulated current, the brightness of the light sources L could also be regulated by means of at least one electronic switch connected in parallel with the light sources; in other words, the current regulator 120 could be replaced with at least one electronic switch connected in parallel with the light sources L.

Figure 8A:
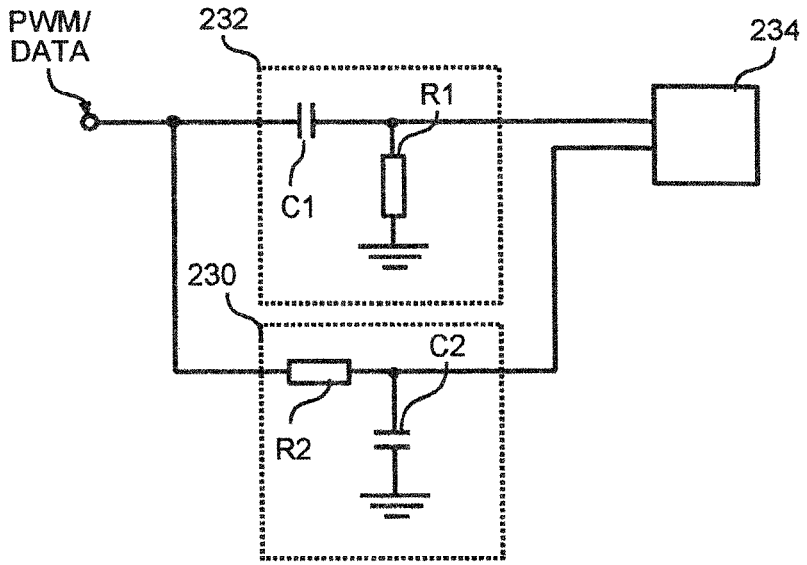
FIGS. 8A and 8B show details of the lighting modules of FIGS. 6 and 7.
Figure 8B:
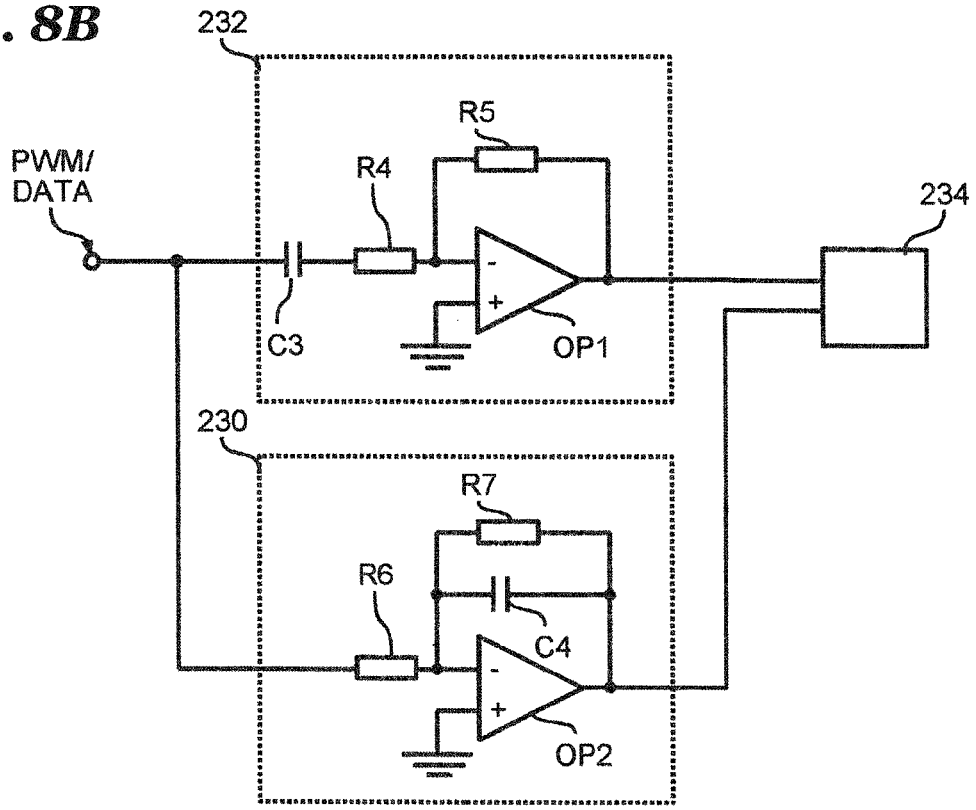

FIGS. 8A and 8B show various embodiments of the filters 230 and 232 which can be used in intelligent lighting modules. As a general rule, as mentioned previously, the simple lighting module 20*a* can also comprise a low-pass filter 230, and therefore the embodiments of the filter shown for an intelligent lighting module can also be used in the simple lighting module 20*a*.

FIG. 8A shows an embodiment in which first-order filters based on passive components are used. This solution has a low cost, but the frequency of the data signal must be substantially different from the frequency of the PWM signal. In particular, in the embodiment under consideration, the high-pass filter 230 comprises a CR filter element, in which the intermediate point between a capacitor C1 and a resistor R1 supplies the filtered signal. Conversely, the low-pass filter 232 comprises an RC filter element, in which the intermediate point between a resistor R2 and a capacitor C2 supplies the filtered signal.

FIG. 8B shows an embodiment in which first-order filters based on active components, in other words at least one operational amplifier, are used. Consequently this solution is more costly, but it optimizes the result of the filtering.

For example, in the embodiment under consideration, the high-pass filter 232 is based on an operational amplifier OP1 in inverting configuration and comprises typical additional components such as a capacitor C3 and two resistors R4 and R5. The low-pass filter 230 can also be based on an operational amplifier OP2 in inverting configuration and can comprise typical additional components such as a capacitor C4 and two resistors R6 and R7.

Persons skilled in the art will be aware that other active filters, including those of higher orders, can also be used. As a general rule it is also possible to use what are known as universal integrated filters, which allow a low filter frequency and a high filter frequency to be set directly.

Consequently, the solutions described herein have numerous advantages; for example, the lighting modules and electronic converters described herein can be used in any configuration, thus also permitting the progressive improvement of the lighting system, and the solutions described herein can also be used in systems comprising a plurality of lighting modules having different colors. In this case, by using a plurality of PWM signals or intelligent lighting modules, it is possible to provide lighting systems emitting white light in which the coloring, in other words the wavelength, and brightness of the light can be set.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A lighting module comprising:

at least one light source, regulating means for regulating the brightness of the light emitted by said at least one light source, and a control unit configured for receiving a brightness control signal, and driving said regulation means as a function of said brightness control signal, wherein said control unit is configured for:

verifying whether said brightness control signal contains a digital communication signal, and if said brightness control signal comprises a digital communication signal, detecting the data transmitted via said digital communication signal and driving said regulating means as a function of said transmitted data, or if said brightness control signal does not comprise a digital communication signal, driving said regulating means as a function of said brightness control signal.

2. The lighting module as claimed in claim 1, wherein said lighting module comprises a first filter configured for detecting in said brightness control signal a digital communication signal.

3. The lighting module as claimed in claim 2, wherein said filter is first order passive or active filter.

4. The lighting module as claimed in claim 2, wherein said lighting module comprises a second filter configured for detecting in said brightness control signal a pulse-width modulated signal, and wherein, if said brightness control signal does not contain a digital communication signal, said control unit drives said regulating means as a function of said pulse-width modulated signal.

5. The lighting module as claimed in claim 1, wherein said lighting module comprises a second filter configured for detecting in said brightness control signal a pulse-width modulated signal, and wherein, if said brightness control signal does not contain a digital communication signal, said control unit drives said regulating means as a function of said pulse-width modulated signal.

6. The lighting module as claimed in claim 5, wherein said filter is first order passive or active filter.

7. The lighting module as claimed in claim 1, wherein said regulating means are a current regulator connected in series with said at least one light source.

8. The lighting module as claimed in claim 1, wherein said light source is a solid state lighting means, such as an LED.

9. The lighting module as claimed in claim 1, wherein said verifying whether said brightness control signal contains a digital communication signal comprises:

sending a signal which indicates the presence of said lighting module when said lighting module is switched on, and verifying whether said brightness control signal contains a digital communication signal comprising an acknowledgement signal.

10. The lighting module as claimed in claim 9, wherein said acknowledgement signal comprises an address for communication with said lighting module.

11. A lighting system, comprising:

at least one lighting module, and an electronic converter configured for supplying said at least one lighting module, wherein said electronic converter is configured for transmitting to said at least one lighting module a brightness control signal comprising a digital communication signal said at least one lighting module comprising:

at least one light source, regulating means for regulating the brightness of the light emitted by said at least one light source, and a control unit configured for receiving a brightness control signal, and driving said regulation means as a function of said brightness control signal, wherein said control unit is configured for:

verifying whether said brightness control signal contains a digital communication signal, and if said brightness control signal comprises a digital communication signal, detecting the data transmitted via said digital communication signal and driving said regulating means as a function of said transmitted data, or if said brightness control signal does not comprise a digital communication signal, driving said regulating means as a function of said brightness control signal.

12. A lighting system, comprising:

at least one lighting module and an electronic converter configured for supplying said at least one lighting module, wherein said electronic converter is configured for transmitting to said at least one lighting module a brightness control signal comprising a pulse-width modulated signal said at least one lighting module comprising:

at least one light source, regulating means for regulating the brightness of the light emitted by said at least one light source, and a control unit configured for receiving a brightness control signal, and driving said regulation means as a function of said brightness control signal, wherein said control unit is configured for:

verifying whether said brightness control signal contains a digital communication signal, and if said brightness control signal comprises a digital communication signal, detecting the data transmitted via said digital communication signal and driving said regulating means as a function of said transmitted data, or if said brightness control signal does not comprise a digital communication signal, driving said regulating means as a function of said brightness control signal.

* * * * *